United States Patent [19]

Garcia

[11] Patent Number: 4,497,351

[45] Date of Patent: Feb. 5, 1985

[54] APPARATUS FOR FILLING A DEVICE WITH A FLUID

[76] Inventor: Tony P. Garcia, P.O. Box 393, Indian Rocks Beach, Fla. 33535

[21] Appl. No.: 449,916

[22] Filed: Dec. 15, 1982

Related U.S. Application Data

[63] Continuation of Ser. No. 199,353, Oct. 21, 1980, abandoned.

[51] Int. Cl.[3] ..... B65B 3/06

[52] U.S. Cl. ..... 141/329; 141/343; 141/364; 141/383; 141/286; 30/443; 222/81

[58] Field of Search ..... 141/98, 19, 329, 330, 141/343, 363-366, 382-386, 284-310, 106; 222/81-91; 30/443, 445; 184/105

[56] References Cited

U.S. PATENT DOCUMENTS

| | | | |
|---|---|---|---|
| 2,130,085 | 9/1938 | Harks | 184/105 |
| 2,130,634 | 9/1938 | Wiswell | 184/105 |
| 2,134,004 | 10/1938 | Pittman | 184/105 |
| 2,329,716 | 9/1943 | Johnson | 221/28 |
| 2,350,451 | 6/1944 | Embrey | 222/81 |
| 2,365,695 | 12/1944 | Grice | 222/488 |
| 2,467,088 | 4/1949 | Konchan | 220/40 |
| 2,644,430 | 7/1953 | Lang | 121/194 |
| 2,693,249 | 11/1954 | Baumbach | 184/105 |
| 3,115,908 | 12/1963 | Carlson | 141/330 |
| 3,331,405 | 7/1967 | Gajdet | 141/330 |
| 3,774,722 | 11/1973 | Elder | 184/105 |
| 3,934,623 | 1/1976 | Hays | 141/330 |
| 3,990,489 | 11/1976 | Ruter | 141/330 |

*Primary Examiner*—Houston S. Bell, Jr.
*Attorney, Agent, or Firm*—Stefan Stein

[57] ABSTRACT

An apparatus for connection to the oil input of an engine which facilitates the emptying of oil contained within a can into the engine. The apparatus comprises a cutting element connected concentrically above the side wall of a base by means of a stand. During use, the operator positions the can above the cutting element and pushes downwardly causing the cutting element to puncture the bottom of the can thereby emptying the oil through the cutting element and through an aperture in the base into the engine. The cutting element includes a rounded step to facilitate removal of the can after emptying. An orientation device is provided to orient the base with respect to the oil input to facilitate easy access to the cutting element. In the preferred embodiment, the orientation device comprises a downwardly biased sprocketed flange which engages a protrusion extending upwardly from the bottom of the base.

16 Claims, 16 Drawing Figures

FIG. 1
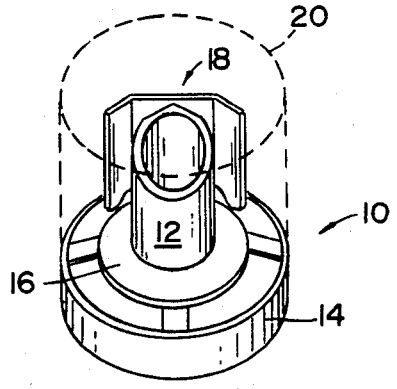
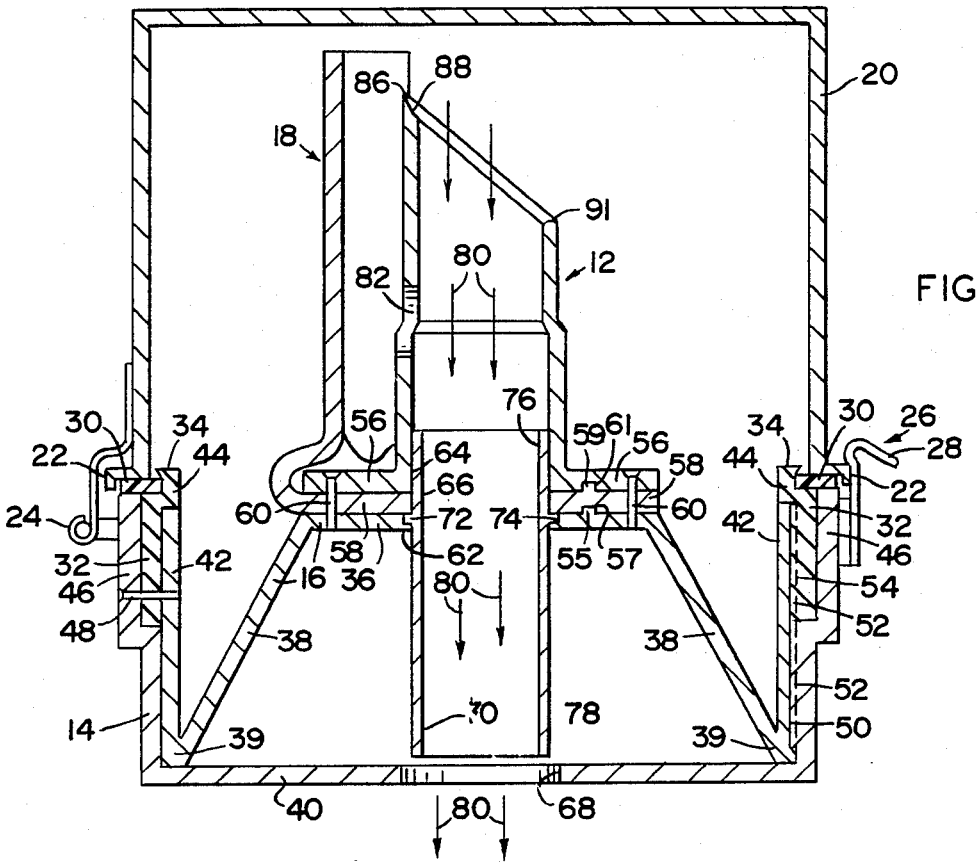
FIG. 2
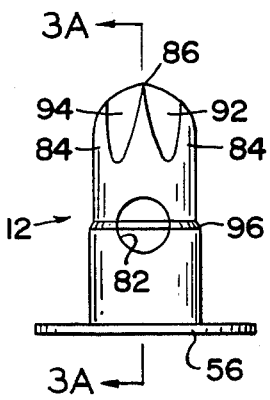
FIG. 3
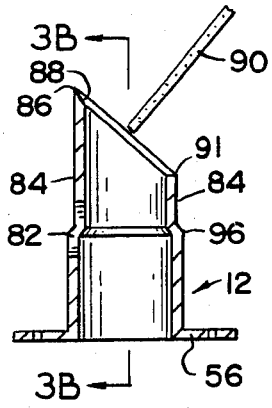
FIG. 3A
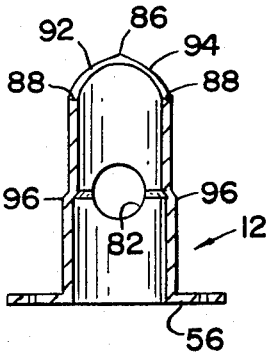
FIG. 3B FIG.4
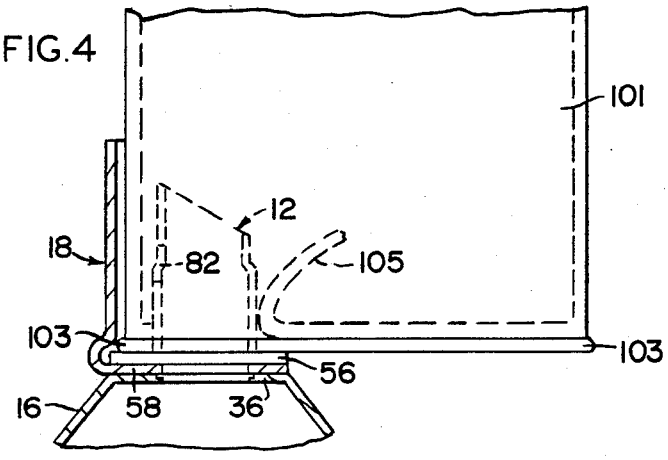
FIG.5
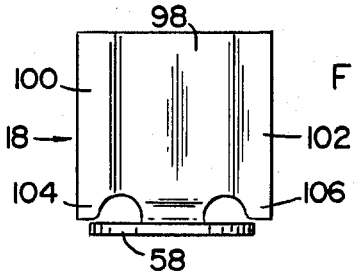
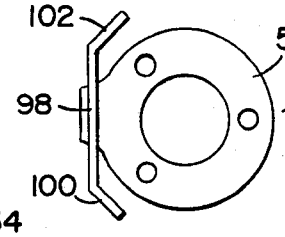
FIG.5A
FIG.6
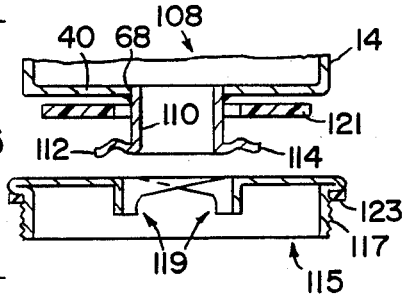
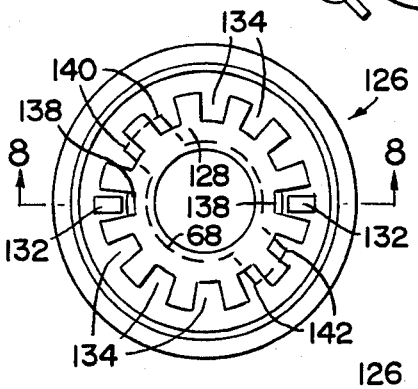
FIG.8A
FIG.7
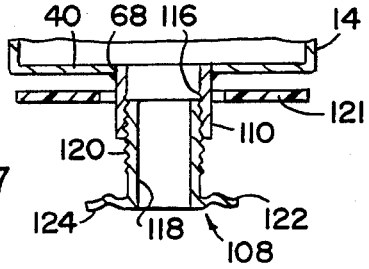
FIG.8
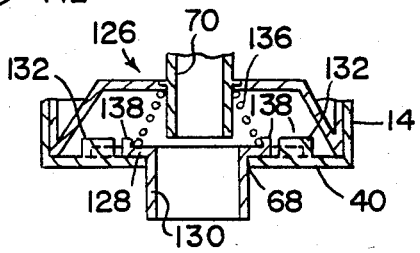
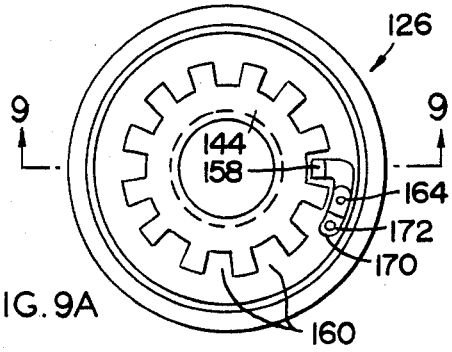
FIG.9A
FIG.10
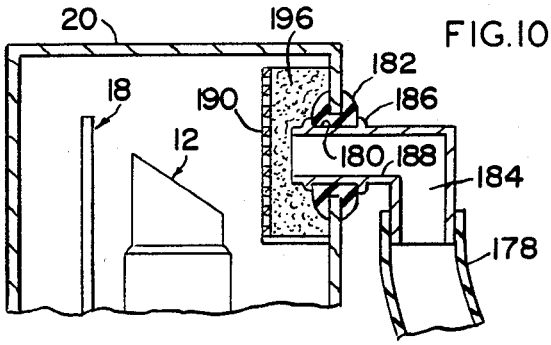
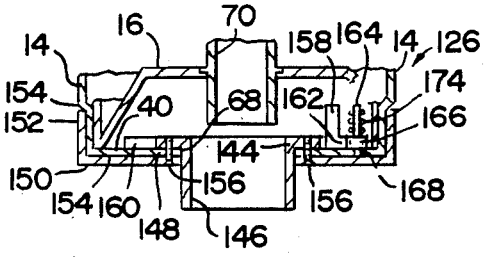
FIG. 9
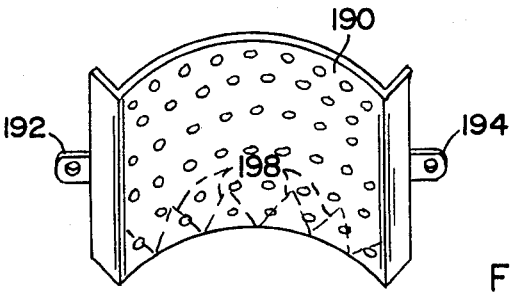
FIG.10A

APPARATUS FOR FILLING A DEVICE WITH A FLUID

This application is a continuation of application Ser. No. 199,353, filed Oct. 21, 1980, now abandoned.

BACKGROUND OF THE INVENTION

1. Field of the Invention

This invention relates to an apparatus having a cutting element connected relative to a base for connection to the oil input of an engine to enable an operator to empty a can of oil into the engine by positioning the can above the cutting element and pushing downwardly on the can.

2. Description of the Prior Art

It is widely known that emptying a can of oil into an automotive engine is usually a messy task which must be accomplished on a regular basis. Various gadgets have been developed in an attempt to enable the average consumer to quickly and easily empty a can of oil into his automobile. The most prevalent gadget comprises a spout having a cutting element connected to the proximal end thereof. The consumer positions the cutting element above the can and pushes downwardly, at which time the cutting element punctures a hole in the can. The consumer then positions the can above the oil input of his engine and attempts to pour the oil into the opening. It is usually the case that the consumer misses the oil input causing the oil to spill onto the exterior of the engine. Moreover, the combination spout and cutting element gadget tends to leak around the opening in the can. After emptying the can, the consumer is faced with the problem of having to store the oily gadget. When stored in a dirty environment, the gadget collects dirt and sand which, upon subsequent use, flows into the engine along with the oil.

In order to overcome many of the inherent disadvantages of the combined spout and cutting element gadget, various other gadgets have been developed. For example, a removable plastic cover having an integral spout has been recently invented. The consumer punctures a hole in the top of the can with a screwdriver or similar tool and then snaps the cover around the rim of the can. The can is then positioned over the oil input of the engine enabling the oil contained therein to flow in the engine. Unfortunately, the consumer is still faced with the problems of spilling the oil on the exterior of the engine and storing the oily spout in a clean environment during nonuse.

Therefore, it is an object of this invention to provide an apparatus which overcomes the aforementioned inadequacies of the prior art devices and provides an improvement which is a significant contribution to the advancement of the art of refilling an engine with oil contained within a can.

Another object of this invention is to provide an apparatus having a cutting element connected relative to a base for puncturing the bottom of a can of oil thereby enabling the oil contained within the can to flow into the engine.

Another object of this invention is to provide an apparatus wherein the cutting edge of the cutting element punctures a smooth hole in the bottom of the can thereby preventing scrap pieces of metal from mixing with the oil and entering the engine.

Another object of this invention is to provide an apparatus wherein the cutting element includes an annular step which facilitates the removal of the can therefrom by rocking the can from side to side.

Another object of this invention is to provide an apparatus which is easily connected to the oil input of the engine by means of a connecting means.

Another object of this invention is to provide an apparatus having an orientation means which enables the apparatus to be oriented relative to the oil input to facilitate easy access to the cutting element.

Another object of this invention is to provide an apparatus having a cap hinged to the base thereof for covering the cutting element during nonuse thereby preventing contamination such as dirt from contaminating the cutting element.

Another object of this invention is to provide an apparatus having an aperture disposed through the wall of the cap and a filter means secured thereabout by means of a cage for venting the crankcase of the engine.

Another object of this invention is to provide an apparatus wherein an elbow conduit is connected through the aperture in the cap for connection to the emission control conduit of the engine.

Other objects and a fuller understanding of this invention may be had by referring to the summary of the invention, the description and the claims, taken in conjunction with the accompanying drawings.

SUMMARY OF THE INVENTION

This invention basically comprises an apparatus securable to the oil input of an engine to enable an operator to empty oil from a can into the engine. Basically, the apparatus comprises a cylindrical cutting element which is connected relative to the base of the apparatus by means of a legged stand. During refilling, the can containing the oil to be emptied into the engine is positioned above the cutting element and then pushed downwardly thereon. The cutting element punctures a hole in the bottom of the can enabling the oil contained therein to flow through the inside cutting element downwardly into the engine. A guide is connected relative to the cutting element to insure that the hole thus punctured in the bottom of the can will be positioned in close proximity to the rim of the can. A cap is provided for covering the apparatus during nonuse, thereby preventing contamination such as dirt from entering the engine. It should be appreciated that the apparatus enables an average consumer to quickly and easily empty a quart of oil into his vehicle or engine. The need for special gadgets or spouts to open the oil can and then emptying the oil into the engine is therefore eliminated.

Other features of the invention include a special formed cutting edge on the upper portion of the cutting element which punctures a smooth hole in the can as the can is pushed downwardly thereon. No pieces of scrap metal which may mix with the oil are produced which may contaminate the oil and enter the engine. The cutting element further includes an annular step disposed about its midsection which forms a tight seal with the opening of the can. Moreover, the annular step facilitates the removal of the can after it is emptied by rocking the can from side to side until the can slips off the annular step.

The apparatus of the invention further includes the feature of being removably adaptable to any type of oil input of an engine. Specifically, a cylindrical member is connected to the bottom of the base of the apparatus. A pair of ears are connected to opposed sides of the cylindrical member for engagement with a standard oil input of an engine. An adapter is provided for connection to the base of the apparatus via the ears which enables the base to be connected to other types of oil inputs by means of a thread. A gasket is positioned between the base of the apparatus in the oil input to form a tight seal therebetween thereby preventing the oil from leaking out and covering the exterior of the engine.

It is noted that in some situations in which the apparatus is installed on the oil input of an engine, the cutting element may be oriented in a position which would make it difficult to mount the oil can thereon. In these instances, the apparatus of the invention further includes an orientation means which enables the base to be rotated to any particular orientation to facilitate easy access to the cutting element. In one embodiment, the orientation means comprises a sprocketed annular flange connected to a cylindrical member positioned within the aperture in the bottom of the base. A protrusion extends from the base in alignment with the plurality of spaces of the sprocketed flange. A spring is provided for biasing the sprocketed flange in an engaged position. To orient the base, the operator pushes upwardly on the sprocketed flange to disengage it from the protrusion. The sprocketed flange may then be rotated to a particular orientation. Upon release, the sprocketed flange returns to its engaged position with the protrusion. The base may then be connected to the oil input via the connecting means described previously.

The second embodiment of the orientation means includes a similar sprocketed flange and an inwardly biased arm which engages one of the plurality of the spaces in sprocketed flange. The base of the apparatus is oriented with respect to the oil input by disengaging the arm from the space and then rotating the sprocketed flange to the desired position. The arm then returns to its engaged position with one of the spaces in the sprocketed flange.

A further feature of the invention is the incorporation of an elbow conduit through the cap. A filter is secured over the opening of the elbow conduit in the cap by means of a cage. The crankcase of the engine may therefore be vented via the elbow conduit. Moveover, the elbow conduit enables the emission control conduit to be connected thereto to provide what is commonly referred to as a closed system.

BRIEF DESCRIPTION OF THE DRAWINGS

For a fuller understanding of the nature and objects of the invention reference should be had to the following detailed description taken in connection with the accompanying drawings in which:

FIG. 1 is a frontal perspective view of the invention;

FIG. 2 is a cross-sectional view of FIG. 1 along lines 2—2;

FIG. 3 is a rear view of the cutting element of the invention;

FIG. 3A is a cross-sectional view of FIG. 3 along lines 3A—3A;

FIG. 3B is a cross-sectional view of FIG. 3 along lines 3B—3B;

FIG. 4 is a partial side view of the invention showing a can which has been opened by the cutting element of the invention;

FIG. 5 is a front view of the guide of the invention;

FIG. 5A is a plan view of the guide of the invention;

FIG. 6 is a cross-sectional view of the first embodiment of the connecting means of the invention;

FIG. 7 is a cross-sectional view of the second embodiment of the connecting means of the invention;

FIG. 8 is a partial cross-sectional view of the invention showing the first embodiment of the orientation means;

FIG. 8A is a plan view of the first embodiment of the orientation means of FIG. 8;

FIG. 9 is a cross-sectional view of the second embodiment of the orientation means;

FIG. 9A is a plan view of FIG. 9 showing the second embodiment of the orientation means;

FIG. 10 is a partial cross-sectional view of the invention showing the elbow conduit connected through the cap for connection to the emission control conduit of the engine; and FIG. 10A is a perspective view of the cage which secures the filter within the cap of the invention.

Similar reference characters refer to similar parts throughout the several views of the drawings.

DETAILED DESCRIPTION OF THE PREFERRED EMBODIMENT

FIG. 1 is a frontal perspective view of an apparatus 10 securable to an oil input of an engine or the like. Basically, the apparatus 10 comprises a cylindrical cutting element 12 which is connected relative to the base 14 of the apparatus 10 by means of a three-legged stand 16. A guide 18 is connected to the rear of the cutting element 12. Finally, a cap 20 is hinged relative to the base 14 for protecting the cutting element 12 during nonuse thereof. In operation, the base 14 is connected to the oil input of the engine. The cap 20 is then opened, thereby exposing the cutting element 12. A can containing the oil to be emptied into the engine is then positioned above the cutting element 12 and pushed downwardly at which time the cutting element 12 punctures the bottom of the can enabling the oil contained therein to flow through the inside of the cutting element 12 downwardly into the engine. The guide 18 assures that the hole thus punctured in the bottom of the can will be positioned in close proximity to the rim of the can.

More particularly, as shown in FIG. 2, the cap 20 comprises a substantially cylindrical cross-section having an annular lip 22 located at the opening thereof. The cap 20 is pivotably connected relative to base 14 by means of a hinge 24. A fastening means 26 is connected to the side of the base 14 opposite the hinge 24. The fastening means 26 comprises a tab 28 which is positioned to snap over the lip 22 of the cap 20 thereby securing the cap 20 in a closed position. An annular gasket 30 is positioned about the upper portion of the base 14 by means of a sleeve 32. The sleeve 32 includes an annular protrusion 34 which overlaps the inner corner of the gasket 30 to secure the gasket 30 relative to the base 14. When the cap 20 is in a closed position, the lip 22 thereof is pressed against the gasket 30 to seal the cap 20 relative to the base 14. Contamination such as water and dirt is therefore precluded from entering the interior of the apparatus 10. Upon opening the cap 20, the protrusion 34 assures that the gasket 30 will remain seated around the periphery of the base 14.

As noted earlier, the cutting element 12 and the guide 18 are connected relative to the base 14 by means of a stand 16. More specifically, stand 16 includes a disc-shaped member 36 having three integral legs 38 connected thereto. The legs 38 angularly extend downwardly to the inside bottom 40 of the base 14. A spacer 42 is connected to the feet 39 of the legs 38. The spacers 42 extend upwardly from the feet 39 of the legs 38 to a stepped portion 44 of the sleeve 32. During assembly, the stand 16 is positioned within the base 14. The sleeve 32 is then placed over the upper portions of the spacers 42 and is inserted between the spacers 42 and the wall 46 of the base 14. The sleeve 32 is then secured in position by means of threaded fasteners 48 such as set screws which extend through the wall 46 of the base 14 to engage the sleeve 32. It is noted that the sleeve 32 may be alternatively secured into position by means of an annular crimp disposed around the wall 46 of the base 14 or a weld.

An orientation protrusion 50 may be incorporated in the bottom portion of the wall 46 of the base 14. The protrusion 50 would mate with a corresponding indentation in one of the legs 38. Such an arrangement would assure proper orientation of the stand 16 with respect to the base 14. Similarly, a second protrusion 54 may be incorporated on the inside portion of the annular sleeve 32 which would also mate with the indentation 52 disposed in one of the legs 38. Proper orientation of the sleeve 32 with respect to both the stand 16 and the base 14 would therefore be assured. Finally, a third protrusion 55 is incorporated into the top of the disc 36 of the stand 16 which would mate with a corresponding indentation 57 in the disc 58 of the guide 18. Similarly, a fourth protrusion 59 is incorporated into the top of the disc 58 of the guide 18 which would mate with a corresponding indentation 61 in the disc 56 of the cutting element 12. It should be appreciated that each of the protrusions 50, 54, 55, and 59 and the corresponding indentations 52, 57, and 61 facilitate the quick and easy assembly of each of the component parts of the apparatus 10 without the need of various jigs to align the components in place during assembly.

As noted earlier, the cutting element 12 and the guide 18 are connected to the stand 16. More specifically, an annular disc 56 is connected to the bottom portion of the cutting element 12. Similarly, another annular disc 58 is connected to the bottom of the guide 18. Both discs 56 and 58 are then rigidly connected to the disc-shaped member 36 of the stand 16 by means of threaded fasteners 60, crimping or spot welding. When the can containing the oil is opened by the cutting element 12, the oil contained within the can flows through the interior of the cutting element 12 through apertures 62, 64, and 66 in the discs, 36, 56, and 58, respectively, and then through another aperture 68 disposed in the bottom 40 of the base 14 to the engine.

In the preferred embodiment of the invention, a flow guide 70 is positioned within each of the apertures 62, 64, and 68 to guide the flow of the oil therethrough. More specifically, flow guide 70 comprises a substantially cylindrical configuration having an annular bead 72 disposed about its midsection. During assembly, the annular bead 72 is seated within an annular step 74 disposed within the disc-shaped member 36 of the stand 16. The disc 58 of the guide 18 is then positioned over the annular bead 72. The flow guide 70 is therefore rigidly secured in place between the guide 18 and the stand 16. Preferably, the upper portion 76 of the flow guide 70 extends into a portion of the cutting element 12. Similarly, the lower portion 78 preferably extends downwardly from the stand 16 to a point substantially horizontal to the bottom 40 of the base 14. The great majority of the oil flowing from the can is therefore guided by the flow guide 70 to flow directly from the inside of the cutting element 12 through the flow guide 70 and exit the base 14 through aperture 68, as shown by arrows 80.

It should be noted that the last few drops of the oil in the can cannot be emptied due to the fact that the cutting elements 12 extends into a portion of the can. To remedy such a situation a hole 82 is located in the wall of the cutting element 12 in a position corresponding to the bottom of the can. The last few drops of oil in the can empties through the hole 82 and flows through the flow guide 70 to the bottom 40 of the base 14 and then into the engine via aperture 68.

As shown in FIGS. 3, 3A, and 3B, the cutting element 12 is specially designed to quickly and uniformly cut a round hole in the can to be emptied. Specifically, the upper portion 84 of the cutting element 12 is angularly formed to define a point 86 which initiates the cutting action into the can. The upper portion 84 of the cutting element 12 is preferably concaved inwardly to define a cutting edge 88 about the periphery of the upper portion 84. Such a cutting edge 88 may be formed in the upper portion 84 by moving a grinding tool 90 having a diameter approximately 5½ times the diameter of the cutting element 12 transversely across the upper portion 84 of the cutting element 12. The upper portion 84 is therefore concave-shaped to define the cutting edge 88 thereabout.

It is noted that by moving the grinding tool 90 transversely across the upper portion 84, the apex 91 of the cutting edge 88 will not be sharpened to the extent that it would cut that part of the can. As shown in FIG. 4, this assures that the slug 105 produced in opening the can 101 will remain attached to the can 101. The slug 105 will therefore be precluded from falling into the engine as the engine is filled with oil. It is also noted that the effectiveness and durability of the point 86 in piercing the can 101 may be enhanced by forming a first and a second flat portion 92 and 94 on opposite sides of the rear of the cutting element 12. The flat portions 92 and 94 assure that the point 86 will smoothly cut into the can 101 without forming pieces of scrap metal which may fall into the interior of the cutting element 12 thereby contaminating the oil being emptied into the engine.

The cutting element 12 further includes an annular rounded step 96 about its midsection. When the can 101 is opened by the cutting edge 88 of the cutting element 12 and is pushed further onto the cutting element 12, the rounded step 96 is tightly forced into the hole thus formed. A tight seal is therefore produced between the formed hole and the cutting element 12 thereby preventing oil from leaking out around the cutting element 12. Moreover, the rounded step 96 facilitates the removal of the can 101 after it is emptied. Specifically, as shown in FIG. 4, the can 101 is easily removed from the cutting element 12 by rocking the can 101 sidewise back and forth until the can 101 slips off of the annular step 96.

As shown in FIGS. 5 and 5A, the guide 18 of the invention comprises a flat portion 98 having two side portions 100 and 102 angled inwardly. Referring again to FIG. 4, the can 101 to be emptied is guided by the guide 18 to assure that the cutting element 12 will puncture a hole in the can 101 relatively close to the rim 103 of the can 101. The guide 18 is therefore preferably a hardened material such as steel which will not be deformed or bent as it is guiding the can 101 onto the cutting element 12. It is noted that a flange 104 and 106 may be connected to the bottom of the side portions 100 and 102, respectively, to prevent the rim 103 of the can 101 from being caught underneath the side portions 100 and 102.

It should be appreciated that the subject invention thus described may be installed on any apparatus or machine which is required to be occasionally refilled with a fluid such as an oil contained within a can 101. In more specific embodiments of this invention, the apparatus 10 may be removably connected to the oil input such as a valve cover of a vehicular engine. When it is necessary to refill the engine with oil, the can 101 containing the oil can be positioned above the cutting element 12, pushed thereon causing the oil to flow through the flow guid 70 into the engine. Accordingly, a means for connecting the invention to the oil input of the engine is provided.

As shown in FIG. 6, the first embodiment of the connecting means 108 comprises a substantially cylindrical member 110 which is rigidly connected about aperture 68 in the bottom 40 of the base 14. A pair of ears 112 and 114 is then connected to opposed sides of the cylindrical member 110. In operation, the ears 112 and 114 extend into corresponding indentations in the oil input of the engine. The base 14 is then rotated to engage the ears 112 and 114 with the sides of the oil input of the engine. It is noted that the oil inputs of some engines comprise a threaded input. In these instances, an adaptor 115 is provided enabling the cylindrical member 110 to be connected to the oil input. Specifically, adaptor 115 comprises a threaded portion 117 for threaded engagement with the oil input of the engine. A connector 119 is located in the center of the adaptor 115 for engagement with the ears 112 and 114 connected to the cylindrical member 110. In operation, the adaptor 115 is threaded into the oil input of the engine. The ears 112 and 114 are inserted within connector 119 at which time the base 14 is rotated causing ears 112 and 114 to tighten within connector 119. A pair of gaskets 121 and 123 may be provided to assure a proper seal between base 14, adaptor 115 and the oil input of the engine.

As shown in FIG. 7, the second embodiment of the connecting means 108 comprises a similar cylindrical member 110 rigidly connected about the aperture 68 in the bottom 40 of the base 14. A thread 116 is disposed about the interior of the cylindrical member 110. A second cylindrical member 18 having external threads 120 disposed thereon is provided for threaded engagement with the first cylindrical member 110. A pair of ears 122 and 124 are rigidly connected to opposed sides of the second cylindrical member 118. It should be appreciated that the second embodiment of the connecting means 108 is adaptable to all types of oil inputs. Specifically, the second cylinder 118 may be used or discarded depending on the particular type of oil input (unthreaded or threaded) on the engine. A gasket 121 is provided to assure a proper seal between the base 14 and the oil input of the engine.

In some situations in which the apparatus 10 is installed on the oil input of an engine, the cutting element 12 may be oriented in a position which would make it difficult to mount the oil can 101 thereon. In these instances, an orientation means 126 is provided which enables the base 14 to be rotated to any particular orientation to facilitate easy access to the cutting element 12. As shown in FIGS. 8 and 8A, the first embodiment of the orientation means 126 comprises a sprocketed annular flange 128 connected to a cylindrical member 130 which is positioned within aperture 68 of the bottom 40 of the base 14. At least one protrusion 132 extends from the inside of the bottom 40 in alignment with the plurality of the spaces 134 of the sprocketed flange 128. A spring 136 is inserted between the sprocketed flange 128 and the stand 16. The spring 136 is centered over the sprocketed flange 128 by means of a plurality of tabs 138 extending therefrom. Similarly, the spring 136 is centered relative to the stand 16 by being disposed about the flow guide 70 located within apertures 62, 64, and 66. In operation, to orient the base 14 relative to the oil input, the operator pushes upwardly on the cylindrical member 130 which causes protrusions 132 to disengage spaces 134. At this point, the cylindrical member 130 may be rotated to any orientation. Upon release of the upward pressure exerted on the cylindrical member 130, the protrusions 132 engage spaces 134 thereby preventing the cylindrical member 130 from rotating with respect to base 14.

It is noted that the cylindrical member 130 may constitute the first cylindrical member 110 of both the first or the second connecting means 108. In these instances, the orientation means 126 can be utilized without having to forfeit the features of the connecting means 108 as previously described. It should be understood that in the case of utilizing the first connecting means 108, in which the ears 112 and 114 are connected to opposed sides of the cylindrical member 110 (130), the aperture 68 in the bottom 40 of the base 14 must include a pair of cut-out portions 140 and 142 which allows, during assembly, room for ears 112 and 114 to be inserted through the aperture 68.

The second embodiment of the orientation means 126 is illustrated in FIGS. 9 and 9A. Basically, the second orientation means 126 comprises a sprocketed flange 144 which is connected to a cylindrical member 146. The sprocketed flange 144 includes an annular inside step portion 148 which is dimensioned to mate with the aperture 68 located in the bottom 40 of the base 14. A bottom cover 150 having an annular wall 152 connected thereto is provided for covering the outside bottom 154 of the base 14. The cover 152 is then connected to the flange 144 by means of threaded fasteners 156 such as screws or by spot welding. The sprocketed flange 144, cylindrical member 146, and cover 150 is then rotatable relative to the base 14. A spring-loaded vertically disposed arm 158 is provided for engagement into one of the plurality of spaces 160 of the sprocketed flange 144. More specifically, the arm 158 includes a bottom portion 162 which is pivotally connected relative to the base 14 by means of a post 164 disposed through a hole 166 in the bottom portion 162 to another hole 168 in the bottom 40 of the base 14. A bracket 170 is disposed about the post 164 and the bottom portion 162 and is connected to the bottom 40 of the base 14 by means of a threaded fastener 172. A spring 174 is then connected over the post 164 and positioned between the arm 158 and the side of the base 14 to continually apply pressure on the arm 158 toward the spaces 160 in the sprocketed flange 144. To orient the apparatus 10 with respect to the oil input of the engine, the operator simply grasps the arm 158 and pushes it sideways to disengage the sprocketed flange 144. The sprocketed flange 144 and the cylindrical member 146 can then be rotated relative to the base 14 to orient the base 14 to a suitable orientation. It should be understood that the cylindrical member 146 of the second embodiment of the orientation means 126 may constitute the cylindrical member 110 of the first or second connecting means 108. The first or the second connecting means 108 can therefore be utilized in conjunction with the second embodiment of the orientation means 126.

In many late model vehicles, an emission control conduit 178 is connected to the oil input of the engine to vent the crankcase during operation. The cap 20 of the apparatus 10 may be modified in order to accommodate the venting of the crankcase. Specifically, as shown in FIGS. 10 and 10A, an aperture 180 is located within the frontal portion of the cap 20. A rubber grommet 182 is then inserted within aperture 180. An elbow conduit 184 is then inserted within the grommet 182 and held in place by means of outer annular beads 186 and 188 which are seated on the inside and outside of the grommet 182. The emission control conduit 178 may then be connected to the elbow conduit 184. A perforated cage 190 is connected on the inside of the cap 20 about aperture 180. Cage 190 comprises an arcuate configuration having tabs 192 and 194 which are connected to the inside of the cap 20 by means of a weld or threaded fasteners. A filter 196 is inserted in the cage 190 and secured in place by bending the bottom portion 198 of the cage 190 toward the cap 20. The crankcase of the engine may therefore be vented through the apparatus 10 and elbow conduit 184 to the emission control conduit 178 or to the atmosphere. In those instances in which the crankcase need not be vented, a solid grommet (not shown) may be provided to seal the aperture 180.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of this invention.

I claim:

1. An apparatus for connection to a fluid input of a device for filling the device with a fluid contained within a container, comprising in combination:

a base including an aperture in the bottom thereof and an upstanding wall;

a substantially cylindrical hollow cutting element including an upper portion angularly formed to define a point for initiating the piercing of a hole in the container and for allowing the fluid to flow from the container into and through said cutting element and then into the device;

a stand means for connecting said cutting element above said upstanding wall of said base in a position substantially concentric to said upstanding wall with said cutting element being completely, noncontiguously, positioned from the upper edge of said upstanding wall to permit the container, partially filled with the fluid, to be prematurely removed from said cutting element and held above said cutting element allowing the remaining fluid in the container to drain therefrom into and through said cutting element and about the exterior of said cutting element and then into the device without spillage of the fluid over the outside of said upstanding wall of said base; and means for connecting said base to the fluid input of the device.

2. The apparatus as set forth in claim 1, further including a substantially cylindrical flow guide disposed between said cutting element and said aperture in said base for guiding the majority of the fluid being emptied from the container directly to said aperture in the bottom of said base.

3. The apparatus as set forth in claim 1, further including a hole located through the wall of said cutting element to enable the last few drops of the fluid to be emptied from the container.

4. The apparatus as set forth in claim 1, further including a guide for guiding the container as the container is pushed downwardly onto said cutting element thereby assuring that a hole thus punctured in the container will be located in close proximity to the edge of the container.

5. The apparatus as set forth in claim 1, wherein said cutting element includes an upper cutting edge having a concave cross-section which is formed by moving a grinding tool transversely across the upper portion of said cutting element.

6. The apparatus as set forth in claim 1, wherein said means for connecting said base to said fluid input comprises a cylindrical member connected about an aperture in the bottom of said base and a pair of ears connected to opposed sides of said cylindrical member for engagement into the edges of the fluid input of the device.

7. The apparatus as set forth in claim 6, further including an adaptor having an external threaded portion for threaded engagement with the fluid input of the device and a connector for engagement with said ears of said cylindrical member.

8. The apparatus as set forth in claims 1, 2, 3, 4 or 5 wherein said means for connecting said base to said fluid input comprises a cylindrical member connected about an aperture in the bottom of said base and a pair of ears connected to opposed sides of said cylindrical member for engagement into the edges of the fluid input of the device.

9. An apparatus for connection to a fluid input of a device for filling a device with a fluid contained within a container, comprising in combination:

a base;

a cutting element for piercing a hole in the container;

means for connecting said cutting element relative to said base;

means for connecting said base to the fluid input of the device; and adjustable orientation means enabling said base to be adjustably oriented in at least three positions relative to the means for connecting said base to the fluid input of the device.

10. An apparatus for connection to a fluid input of a device for filling a device with a fluid contained within a container, comprising in combination:

a base;

a cutting element for piercing a hole in the container;

means for connecting said cutting element relative to said base;

means for connecting said base to the fluid input of the device; and orientation means enabling said base to be oriented relative to the fluid input of the device, said orientation means comprising in combination:

a sprocketed flange rotatably disposed within an aperture in the bottom of said base;

a protrusion extending from the bottom of said base; and means for resiliently biasing said sprocketed flange toward the bottom of said base for engagement with said protrusion;

whereby said base is adjustably oriented relative to the fluid input of the device by disengaging said sprocketed flange from said protrusion and rotating said sprocketed flange with respect to said base.

11. An apparatus for connection to a fluid input of a device for filling a device with a fluid contained within a container, comprising in combination:

a base;

a cutting element for piercing a hole in the container;

means for connecting said cutting element relative to said base;

means for connecting said base to the fluid input of the device; and orientation means enabling said base to be oriented relative to the fluid input of the device, said orientation means comprising in combination:

a sprocketed flange rotatably disposed within an aperture in the bottom of said base;

an arm pivotably connected to said base; and means for biasing said arm toward said sprocketed flanged for engagement therewith;

whereby said base is oriented to a particular position relative to the fluid input of the device by moving said arm from said sprocketed flange to a nonengaged position and then rotating said sprocketed flange to the desired orientation.

12. The apparatus as set forth in claim 1, further comprising in combination:

a cap;

means for pivotably connecting said cap to said base; and means for fastening said cap to said base when said cap is in a closed position.

13. The apparatus as set forth in claim 12, further including an aperture disposed within said cap for venting the device when said cap is in a closed position.

14. The apparatus as set forth in claim 13, further including a grommet disposed within said aperture in said cap enabling a conduit to be connected within said aperture in said cap.

15. The apparatus as set forth in claim 13, further including a solid grommet disposed within said aperture in said cap for plugging said aperture in said cap.

16. An apparatus for connection to a fluid input of a device for filling a device with a fluid contained within a container, comprising in combination:

a base;

a substantially cylindrical hollow cutting element for piercing a hole in the container;

said cutting element including an elongated configuration having a reduced diameter portion at the terminal end thereof and an increased diameter portion at the proximal end thereof defining a substantially concentric annular rounded step to facilitate removal of the container from said cutting element;

means for connecting said cutting element relative to said base; and means for connecting said base to the fluid input of the device.

* * * * *